US005718083A

United States Patent [19]

Dowdell, II

[11] Patent Number: 5,718,083

[45] Date of Patent: Feb. 17, 1998

[54] STOPPER FOR SLIDING DOORS

[76] Inventor: Ralph W. Dowdell, II, 5580 Belmont Manor Dr., Pipersville, Pa. 18947

[21] Appl. No.: 780,959

[22] Filed: Jan. 10, 1997

[51] Int. Cl.[6] ..... E05D 15/16

[52] U.S. Cl. ..... 49/407; 312/334.46; 49/506

[58] Field of Search ..... 49/404, 407, 406, 49/409, 506; 16/23, 24; 312/334.44, 334.45, 334.46, 334.23, 334.26

[56] References Cited

U.S. PATENT DOCUMENTS

| | | | |
|---|---|---|---|
| 3,333,363 | 8/1967 | Garvey | 49/407 X |
| 3,658,398 | 4/1972 | Abbate et al. | 312/334.44 X |
| 4,788,744 | 12/1988 | Warner | 49/407 X |
| 5,233,724 | 8/1993 | Lei tert et al. | 160/202 X |
| 5,242,222 | 9/1993 | Michael | 312/334.46 X |

*Primary Examiner*—Jerry Redman
*Attorney, Agent, or Firm*—William H. Eilberg

[57] ABSTRACT

A sliding door system includes a pair of sliding doors which ride on J-shaped tracks. A stopper, formed of a block of deformable material, has a J-shaped channel which generally matches the contour of the J-shaped tracks. One presses the stopper onto the inner track, at one of the ends of the track. When the inner door is moved to an extreme position, it abuts the stopper, and cannot reach the door frame. Thus, there is a recess between the door frame and the inner door. The recess makes it easy to move the inner door when it is desired to close the closet. Also, the stopper prevents an indentation, formed on the inner door, from being obscured by the outer door, when the inner door is opened. The stopper is made of an elastomeric material so that it can be easily inserted onto the track, without special tools. Thus, the stopper can be easily retrofitted onto existing tracks for sliding door systems, without modifying such systems.

9 Claims, 3 Drawing Sheets

STOPPER FOR SLIDING DOORS

BACKGROUND OF THE INVENTION

This invention relates to the field of sliding doors, and provides a stopper device which makes it easier to operate such doors.

Sliding door systems are commonly used in closets in the home, and elsewhere. In a typical arrangement, a sliding door system includes two sliding doors, both doors being connected to rollers that ride on J-shaped tracks mounted to a frame. The tracks are mounted at the top of the doors, so the tracks comprise means for suspending the doors, in addition to guiding the rollers.

One problem with sliding doors is that, unless a suitable gripping means is formed with the door, it is inconvenient to open and close the doors from certain positions. For example, when the doors are closed, i.e. one door being positioned at the extreme left and the other door being positioned at the extreme right, it is inconvenient to open one or both of the doors because there is no readily available place to grip the doors by hand.

It is not feasible to provide a handle which protrudes too much from the inner door, because such a handle would interfere with the movement of the doors.

A solution to the above-described problem is to provide indentations in the outward-facing surfaces of the doors, to serve as handles, without interfering with the movement of the doors. But even where the doors are provided with such indentations, it is still inconvenient to move the inner door when the inner door is completely hidden by the outer door, because the indentation on the inner door is not accessible. Thus, the indentations do not fully solve the problem.

The present invention provides a simple solution to the problem of operating sliding doors that have no outwardly-protruding handles. The present invention can be implemented very easily and inexpensively on existing doors.

SUMMARY OF THE INVENTION

The present invention includes a stopper, made of an elastomeric material such as rubber or foam, the stopper having a J-shaped channel which matches the shape of the track of a sliding door system. The J-shaped channel extends through an entire dimension of the stopper.

The stopper is inserted onto the inner track of a sliding door system, preferably at the extreme left or right hand side. The J-shape of the channel insures that the stopper, once it is pressed onto the track, will engage the track, and will not fall off. The stopper prevents the inner door, when opened, from sliding into abutment with the door frame. Thus, when the inner door is opened, there will always be a recess between the frame and the inner door. If the stopper is large enough in its length dimension, the recess will be wide enough to allow the user to insert a hand into the recess. The recess therefore facilitates opening and closing of the door, because one can easily grasp the door when it does not immediately abut the door frame.

Because the stopper is located on the inner track, the stopper is not visible when the doors are in their fully closed position.

The present invention therefore has the primary object of providing a sliding door system having a stopper.

The invention has the further object of providing a sliding door system which makes it easier to open and close the doors.

The invention has the further object of making it easier to close an inner door of a sliding door system, even when such inner door has moved to its fully "open" position as modified by the inclusion of the stopper.

The invention has the further object of providing a stopper as described above, wherein the stopper can be quickly and easily installed on existing sliding door systems, without any modification of such systems.

The reader skilled in the art will recognize other objects and advantages of the invention, from a reading of the following brief description of the drawings, the detailed description of the invention, and the appended claims.

DETAILED DESCRIPTION OF THE INVENTION

Figure 2:
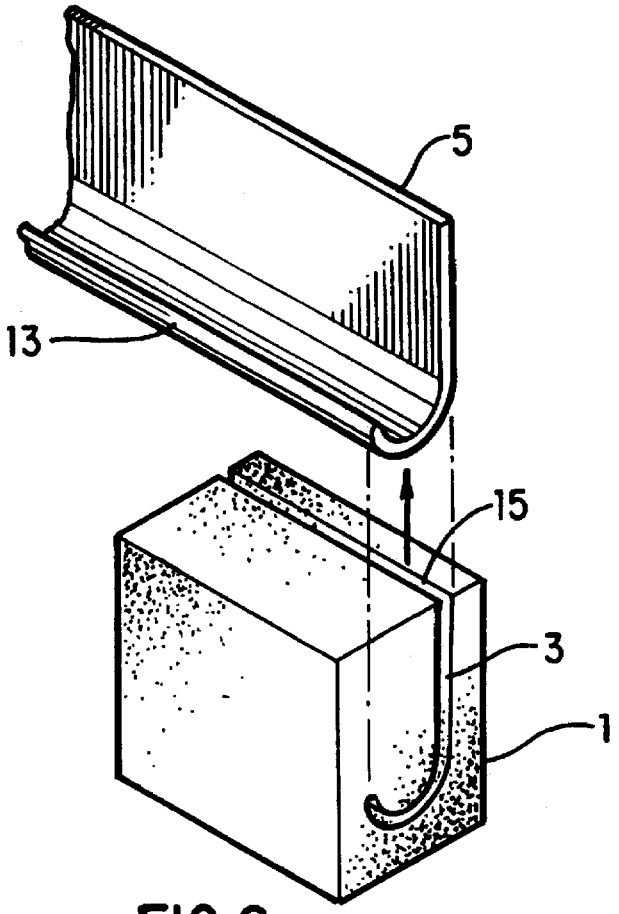
FIG. 2 provides a fragmentary perspective view of the stopper of the present invention as it is about to be pressed onto the track of a sliding door.

As shown in FIG. 2, the stopper 1 of the present invention comprises a block of material, preferably made of an elastomeric substance such as foam or rubber, or any other flexible and deformable substance. The stopper preferably has the form of a parallelepiped, but need not have this exact shape. The stopper includes J-shaped channel 3. The J-shaped channel extends along an entire dimension (such as the length) of the stopper.

Figure 1:
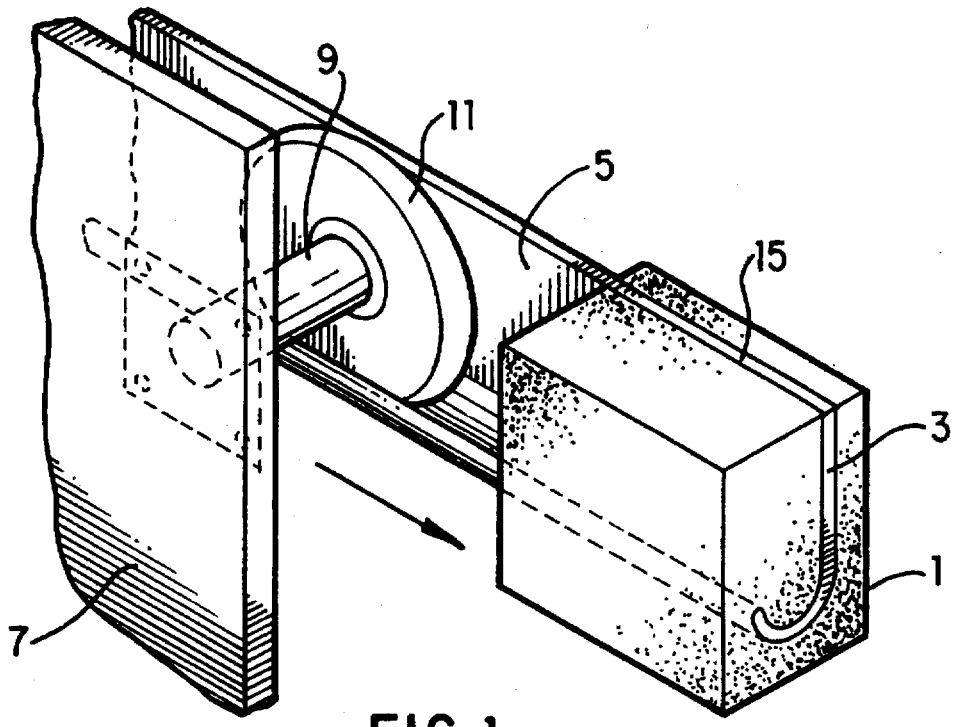
FIG. 1 provides a fragmentary perspective view of the stopper of the present invention, the stopper being shown attached to a track of a sliding door.

The J-shaped channel is configured to match the contour of the J-shaped tracks 5 which support the rollers attached to the sliding doors. FIG. 1 shows a fragment of sliding door 7, attached by axle 9 to roller 11. Roller 11 rests on the upper (concave) surface of the curved portion of J-shaped track 5. Thus, the track 5, by supporting roller 11, effectively provides support for the sliding door, and also defines a direction of lateral movement for the door. FIG. 1 shows how stopper 1 fits snugly over track 5.

The stopper is affixed to the J-shaped track simply by applying pressure. That is, one simply pushes the stopper so that the lip 13 of the track engages the straight portion 15 of the J-shaped channel. One then pushes the stopper still further, in the direction of the track, so that the track and the stopper become fully engaged. Of course, it is necessary to deform the stopper momentarily to insert it onto the track. Note that it is not possible simply to slide the stopper onto the end of the track because, in practice, the track is already mounted to a door frame.

Figure 3:
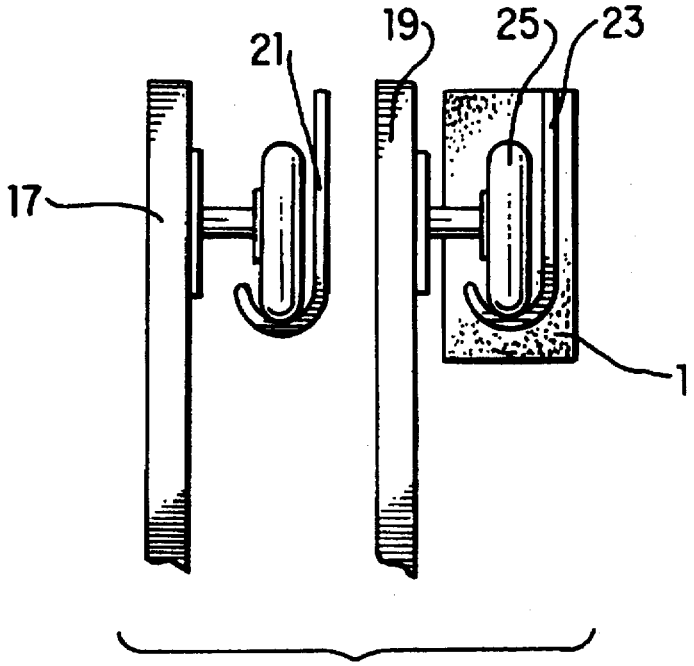
FIG. 3 provides an end view of two sliding doors of a sliding door system, and showing the stopper of the present invention attached to one of the tracks.

FIG. 3 shows an end view of a pair of sliding doors, with the stopper of the present invention installed. FIG. 3 is not drawn to scale; in practice, the doors may be positioned much closer to each other. Reference numeral 17 indicates the outer door, as would be seen by the user from outside the closet, and reference numeral 19 indicates the inner door. Doors 17 and 19 are supported by outer track 21 and inner track 23, respectively, in the same manner as was explained with reference to FIG. 1. Stopper 1 has been inserted onto an end of inner track 23, in the manner already described.

Figure 4:
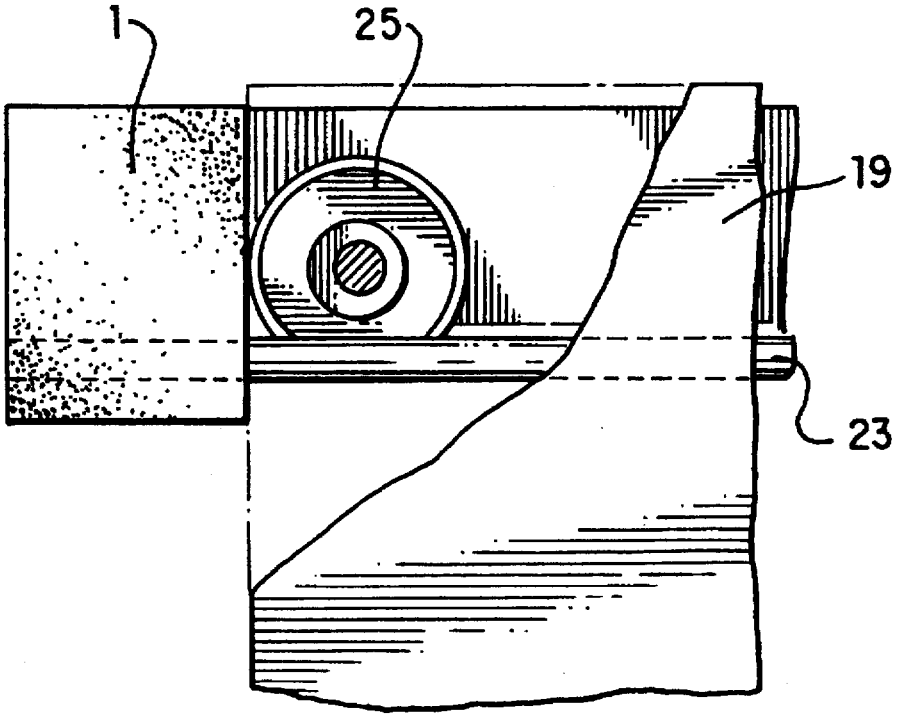
FIG. 4 provides a front view, partly broken away, showing the inner door in abutment with the stopper of the present invention.

FIG. 4 shows the configuration of the doors relative to the stopper, in a front view. FIG. 4 shows stopper 1 attached to inner track 23. Roller 25 rides within inner track 23. The roller is connected to inner door 19, which is shown broken away for purposes of illustration. In the position represented by FIG. 4, the inner door 19 has been moved all the way to the left, and abuts stopper 1. Thus, the inner door cannot move further to the left, due to the presence of the stopper.

Figure 5:
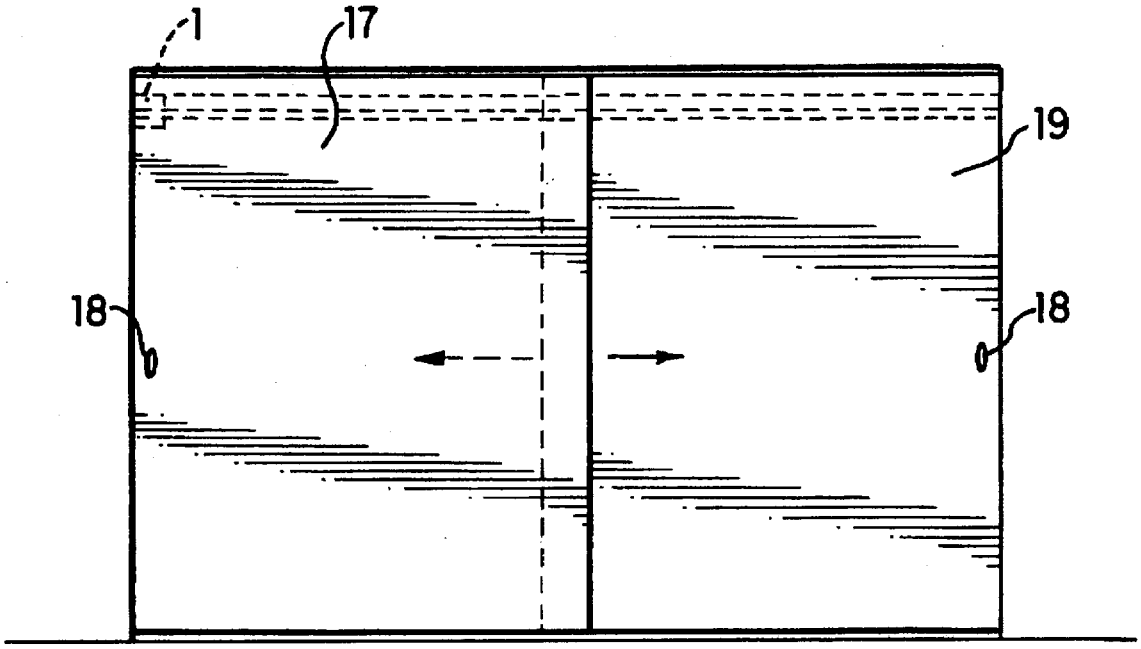
FIG. 5 provides a front view of a pair of sliding doors, in the fully closed position, and showing the stopper of the present invention in dotted outline.
Figure 6:
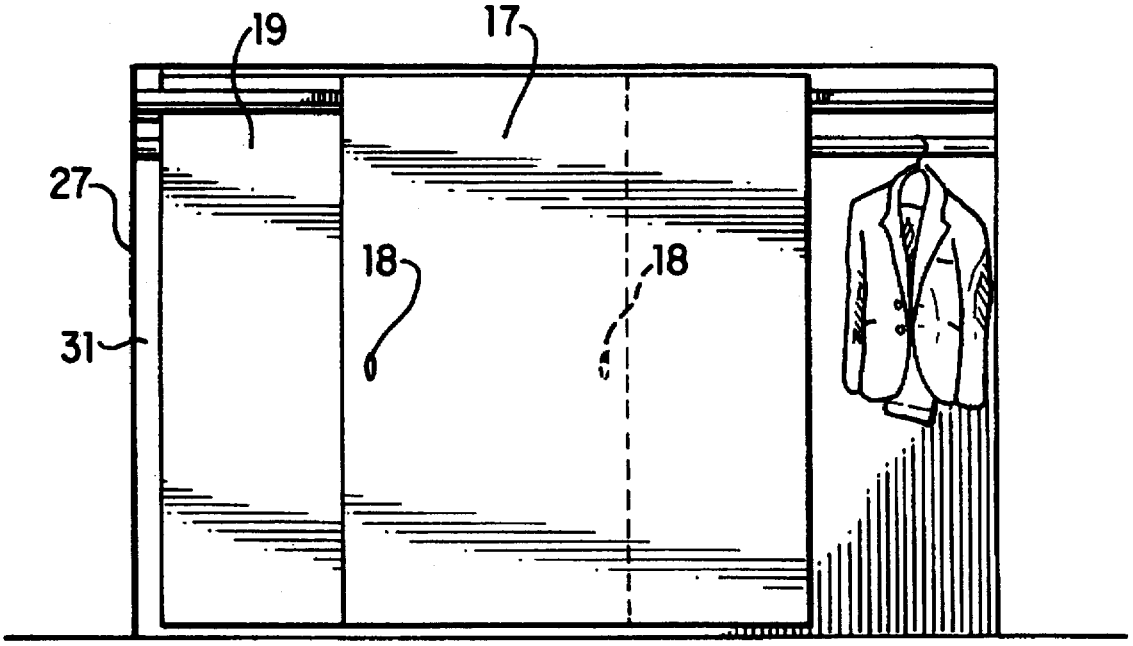
FIG. 6 provides a front view of a pair of sliding doors, in an open position, showing the stopper of the present invention.

FIGS. 5 and 6 illustrate the use of the present invention in a two-door sliding door system for a closet. In FIG. 5, the closet is closed. Outer door 17 has been moved all the way to the left, and inner door 19 has been moved all the way to the right. Both doors have indentations 18, suitable for gripping with the fingers, and both indentations are visible in these figures. The left-hand boundary of the inner door is illustrated in dotted outline. Stopper 1 is also shown in dotted outline because it is not visible from outside the closet when the doors are in the illustrated position. Note that in the position of FIG. 5, the stopper is still affixed to the track, but the stopper is not touching either door.

From FIG. 5, it is clear that, when inner door 19 slides all the way to the left, stopper 1 will prevent the indentation on door 19 from disappearing behind outer door 17. That is, the inner door cannot move all the way to door frame 27 due to the presence of the stopper. The dimensions of the stopper are therefore chosen, in part, according to the distance between the indentation and the adjacent edge of the door, to insure that the indentation will not be obscured when the inner door is moved all the way to the left.

In FIG. 6, the inner door 19 has been moved to the left, as far as it will go, and the outer door 17 has been moved somewhat to the right. In this position, the outer door hides the indentation of the inner door, which indentation is therefore shown in dotted outline. But due to the presence of the stopper, even when the inner door has moved as far leftward as possible, there is still a recess 31 between the door frame and the inner door. This recess allows one to insert a hand or finger between the frame and the inner door, and therefore to manipulate the inner door conveniently.

The stopper is preferably made of an elastomeric material which has the flexibility and memory necessary to cause the stopper to cling to the track, so as to stay in place, while still being able to yield enough to cushion the stopping of the approaching door when contact is made.

The present invention can be implemented very inexpensively and very easily, because the only equipment that is required is a flexible stopper which has been cut with a channel of the appropriate shape. The stopper can then be pressed onto an existing inner track of a sliding door system, and the system will function as described above. No installation tools are necessary.

While the invention has been described with respect to specific embodiments, other modifications are possible. The exact shape of the stopper can be varied. Also, the shape of the channel can be varied according to the corresponding shape of the track being used. The J-shaped track is not the only possibility. The invention is not limited to use with closet doors, but can be used with virtually any sliding door system having a pair of doors which slide along overhead tracks. While the figures show the wheels positioned below the top surface of the doors, it is also possible to position the wheels above the doors. These and other modifications, which will be apparent to the reader skilled in the art, should be considered within the spirit and scope of the following claims.

What is claimed is:

1. A sliding door system comprising:

a) an inner track and an outer track, the inner and outer tracks being mounted to a door frame, the inner and outer tracks having a shape, b) an inner door and an outer door, the inner door having means for engaging the inner track, the outer door having means for engaging the outer track, and c) a stopper, the stopper being made of a deformable material, the stopper having a channel formed therein, the channel having a shape which corresponds to the shape of the inner track, the stopper being inserted onto the inner track.

2. The sliding door system of claim 1, wherein the inner and outer tracks are J-shaped.

3. The sliding door system of claim 1, wherein the inner track has an end, and wherein the stopper is inserted onto the inner track at its end.

4. The sliding door system of claim 1, wherein the means for engaging comprise rollers which ride on the tracks.

5. The system of claim 1, wherein at least the inner door has an indentation formed therein.

6. The system of claim 5, wherein the indentation is located a predetermined distance from an edge of the inner door, and wherein the stopper has a dimension which is chosen according to said predetermined distance.

7. A method of operating a sliding door system, the system including inner and outer doors, the inner and outer doors being supported by means for engaging inner and outer tracks which are mounted to a door frame, the method comprising the steps of:

a) affixing a stopper to an end of the inner track, b) closing the doors by moving the outer door to an extreme position such that the outer door hides the stopper and by moving the inner door to an extreme position opposite to that of the outer door, and c) opening the doors by moving the inner door to an extreme position opposite to the extreme position of the inner door in step (b), and moving the outer door to an extreme position opposite to the extreme position of the outer door in step (b), wherein the inner door abuts the stopper, and wherein there is a recess between the door frame and the inner door.

8. The method of claim 7, wherein the affixing step comprises the step of holding the stopper against the inner track, and pressing the stopper onto the inner track.

9. The method of claim 7, wherein step (b) includes the step of moving the outer door such that the outer door hides the stopper.

* * * * *